US012680718B2

(12) United States Patent
Li et al.

(10) Patent No.: US 12,680,718 B2
(45) Date of Patent: Jul. 14, 2026

(54) TEMPERATURE CONTROLLER, SERVER, AIR CONDITIONING SYSTEM AND TEMPERATURE SETTING METHOD

(71) Applicant: Carrier Corporation, Palm Beach Gardens, FL (US)

(72) Inventors: Qian Li, Shanghai (CN); Yuhui Kuang, Shanghai (CN); Tiejun Wu, Farmington, CT (US); Runfu Shi, Shanghai (CN); Hongsheng Liu, Shanghai (CN); Xinyi Gao, Shanghai (CN); Xin Liang, Shanghai (CN); Yingchao Jiang, Shanghai (CN); Lei Yu, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 245 days.

(21) Appl. No.: 18/466,934

(22) Filed: Sep. 14, 2023

(65) Prior Publication Data

US 2025/0085014 A1 Mar. 13, 2025

(51) Int. Cl.
*F24F 11/65* (2018.01)
*F24F 11/47* (2018.01)

(52) U.S. Cl.
CPC ..... *F24F 11/65* (2018.01); *F24F 11/47* (2018.01)

(58) Field of Classification Search
CPC .. F24F 11/65; F24F 11/47; F24F 11/46; F24F 11/89; F24F 11/64; F24F 2140/60; F24F 2110/10; G06Q 10/06314
See application file for complete search history.

(56) References Cited

U.S. PATENT DOCUMENTS

| | | | | |
|---|---|---|---|---|
| 10,094,586 | B2 * | 10/2018 | Pavlovski | G05D 23/1917 |
| 2015/0276253 | A1 | 10/2015 | Montalvo | |
| 2016/0305678 | A1 | 10/2016 | Pavlovski et al. | |
| 2022/0381471 | A1 * | 12/2022 | Wenzel | G05B 13/048 |

FOREIGN PATENT DOCUMENTS

| | | | | |
|---|---|---|---|---|
| CN | 114877508 A | * | 8/2022 | H02J 7/35 |
| CN | 115200167 A | * | 10/2022 | F24F 11/46 |

OTHER PUBLICATIONS

Extended European Search Report received for EP Application No. 24197932.7, mailed on Jan. 23, 2025, 8 Pages.

* cited by examiner

*Primary Examiner* — Mong-Shune Chung
(74) *Attorney, Agent, or Firm* — Drew Folgmann

(57) ABSTRACT

Disclosed is a temperature controller, a server, an air conditioning system and a temperature setting method. The temperature controller may be configured to operate in a carbon saving mode, and when operating in the carbon saving mode, the set temperature of the temperature controller is adjusted according to a green electricity index, and the green electricity index is the proportion of green electricity in a power grid to which the temperature controller is connected. When the proportion of the green electricity is high, i.e., the electric energy used is mainly from renewable energy sources, the set temperature is adjusted to produce more cold energy or heat energy for storage; and when the green electricity index decreases, the stored cold energy or heat energy can be used to meet the demand for cooling or heating, thereby reducing carbon emissions.

17 Claims, 2 Drawing Sheets

TEMPERATURE CONTROLLER, SERVER, AIR CONDITIONING SYSTEM AND TEMPERATURE SETTING METHOD

CROSS REFERENCE TO RELATED APPLICATIONS

This application claims priority to Chinese Patent Application No. 202311156943.9 filed on Sep. 7, 2023, which is incorporated by reference herein in its entirety.

TECHNICAL FIELD

The present application relates to the field of heating or cooling devices, and particularly relates to a temperature controller, a server, an air conditioning system, and a temperature setting method.

BACKGROUND ART

The electric energy in a power grid is divided into thermal electricity and green electricity on the basis of its source. The thermal electricity mainly refers to the electricity generated by thermal energy produced during combustion of solid, liquid, and gas fuels such as coal, petroleum, and natural gas. These fuels are all fossil fuels and are not renewable. Green electricity, also known as environment-friendly power, is electricity generated using renewable energy sources such as solar energy, wind energy, nuclear energy, hydro energy, biomass, and other resources.

On the other hand, according to the statistics, the carbon dioxide emissions generated by construction operations account for 27% of the global carbon dioxide emissions, and are about 10 gigatons of carbon dioxide, posing an unprecedented challenge to carbon reduction. A large proportion of carbon emissions are caused by electric appliances used for air-conditioning (controlling temperature), such as air conditioning systems, electric heaters, and floor heaters. However, the existing electric appliances used for controlling temperature cannot efficiently utilize green electricity.

SUMMARY OF THE INVENTION

Directing at the above problems, the present application provides a temperature controller, a server, an air conditioning system, and a temperature setting method for solving or alleviating part of the problems in the prior art.

In the first aspect, the present application provides a temperature controller. The temperature controller may be configured to operate in a carbon saving mode, and when operating in the carbon saving mode, the set temperature of the temperature controller is adjusted according to a green electricity index, and the green electricity index is the proportion of green electricity in a power grid to which the temperature controller is connected.

In an optional technical solution, the temperature controller includes a communication module, and when the temperature controller operates in the carbon saving mode, the communication module uploads a current set temperature and receives an updated set temperature based on the green electricity index.

In an optional technical solution, the temperature controller further comprises a positioning module, the positioning module is used for storing or determining installation location information of the temperature controller, and the communication module also uploads the installation location information so as to find the green electricity index on the basis of the installation location information.

In an optional technical solution, the communication module uploads the current set temperature and receives the updated set temperature at a specified time, or at a specified time interval, or in real time.

In an optional technical solution, in a case that the temperature controller controls a cooling system, if the green electricity index increases, the set temperature is decreased, and if the green electricity index decreases, the set temperature is increased.

In an optional technical solution, in a case that the temperature controller controls a heating system, if the green electricity index increases, the set temperature is increased, and if the green electricity index decreases, the set temperature is decreased.

In an optional technical solution, the temperature controller also adjusts the set temperature according to a trend prediction result of the green electricity index.

In the second aspect, the present application provides a server, comprising a processor and a memory, the memory storing processor-readable instructions, the processor performing, by running the processor-readable instructions, the following steps:

receiving a current set temperature of a temperature controller;

according to a green electricity index of a power grid to which the temperature controller is connected, adjusting the set temperature of the temperature controller so as to obtain an updated set temperature, the green electricity index being the proportion of green electricity in the power grid to which the temperature controller is connected; and sending the updated set temperature to the temperature controller.

In an optional technical solution, the processor further performs, by running the processor-readable instructions, the following steps:

receiving installation location information of the temperature controller; and on the basis of the installation location information, finding the green electricity index of the power grid to which the temperature controller is connected.

In an optional technical solution, the step of "according to a green electricity index of a power grid to which the temperature controller is connected, adjusting the set temperature of the temperature controller" includes:

in a case that the temperature controller controls a cooling system, and the green electricity index increases, decreasing the set temperature; and in a case that the temperature controller controls a cooling system, and the green electricity index decrease, increasing the set temperature.

In an optional technical solution, the step of "according to a green electricity index of a power grid to which the temperature controller is connected, adjusting the set temperature of the temperature controller" includes:

in a case that the temperature controller controls a heating system, and the green electricity index increases, increasing the set temperature; and in a case that the temperature controller controls a heating system, and the green electricity index decreases, decreasing the set temperature.

In an optional technical solution, the processor further performs, by running the processor-readable instructions, the following steps:

according to the historical record of the green electricity index of the power grid to which the temperature controller is connected, predicting the change tendency of the green electricity index to obtain a tendency prediction result; and in the step of "according to a green electricity index of a power grid to which the temperature controller is connected, adjusting the set temperature of the temperature controller", further according to the tendency prediction result, adjusting the set temperature.

In the third aspect, the present application provides an air conditioning system, the air conditioner system having a temperature controller provided in the first aspect of the present application, and/or a server provided in the second aspect of the present application.

In the fourth aspect, the present application provides a temperature setting method of an electric appliance for controlling temperature, including the following steps:

according to a green electricity index of a power grid to which the electric appliance is connected, adjusting the set temperature of the electric appliance, the green electricity index being the proportion of green electricity in the power grid to which the electric appliance is connected.

In an optional technical solution, the method further includes the following step: on the basis of the installation location information of the electric appliance, finding the green electricity index of the power grid to which the electric appliance is connected.

In an optional technical solution, the electric appliance is used for cooling, and the step of "according to a green electricity index of a power grid to which the electric appliance is connected, adjusting the set temperature of the electric appliance" includes:

in a case that the green electricity index increases, decreasing the set temperature; and in a case that the green electricity index decrease, increasing the set temperature.

In an optional technical solution, the electric appliance is used for heating, and the step of "according to a green electricity index of a power grid to which the electric appliance is connected, adjusting the set temperature of the electric appliance" includes:

in a case that the green electricity index increases, increasing the set temperature; and in a case that the green electricity index decrease, decreasing the set temperature.

In an optional technical solution, the method further includes the following steps:

according to the historical record of the green electricity index of the power grid to which the electric appliance is connected, predicting the change tendency of the green electricity index to obtain a tendency prediction result; and in the step of "according to a green electricity index of a power grid to which the electric appliance is connected, adjusting the set temperature of the electric appliance", further, according to the tendency prediction result, adjusting the set temperature.

The temperature controller, the server, the air conditioning system, and the temperature setting method according to the present application can improve the utilization efficiency for green electricity and reduce carbon emissions.

DESCRIPTIONS OF THE DRAWINGS

Figure 1:
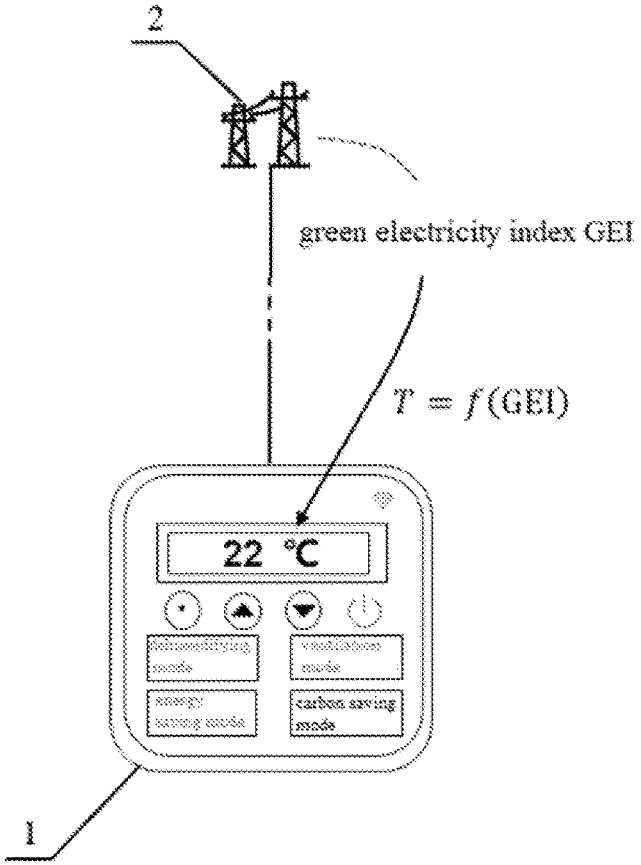
FIG. 1 is a schematic view of a temperature controller operating in a carbon saving mode in one or more embodiments of the present application.

List of Reference Numerals: 1—temperature controller; 11—communication module; 13—positioning module; 15—temperature control module; 2—power grid; 3—server; 31—communication module; 33—processor; 35—memory; and 4—power grid server.

DETAILED DESCRIPTION

The technical solutions in embodiments of the present application will be clearly and completely described below with reference to the accompanying drawings in the embodiments of the present application. Apparently, the described embodiments are merely some rather than all of the embodiments of the present application. Based on the embodiments in the present application, all other embodiments obtained by those of ordinary skill in the art without creative effort fall within the protection scope of the present application.

Temperature Controller

As shown in FIG. 1, an embodiment of the present application provides a temperature controller 1, the temperature controller is electrically connected to an electric appliance for controlling temperature (heating or cooling), and the set temperature thereof is used for controlling a target temperature of the electric appliance. In the present embodiment, the temperature controller 1 may be configured to operate in a carbon saving mode, and when operating in the carbon saving mode, the set temperature of the temperature controller 1 is adjusted according to a green electricity index GEI. The green electricity index GEI is the proportion of green electricity in a power grid to which the temperature controller 1 is connected.

When the proportion of the green electricity is high, i.e., when electric energy in the power grid is mainly from renewable energy sources, such as during the peak period of clean energy sources such as wind electricity and photovoltaic energy, by adjusting the set temperature of the temperature controller 1, the green electricity can be more converted into cold energy or heat energy and stored in a building envelope or other mediums (e.g., circulating medium water). For example, when the electric appliance performs cooling in summer, the set temperature of the temperature controller 1 can be appropriately decreased to store cold energy; when the electric appliance performs heating in winter, the set temperature of the temperature controller 1 can be appropriately increased to store heat energy.

When the green electricity index GEI is low, i.e., when electric energy in the power grid is mainly thermal electricity, such as during the trough period of clean energy sources such as wind electricity and photovoltaic energy, by adjusting the set temperature of the temperature controller 1, the electricity consumption in the time period can be reduced. For example when the electric appliance performs cooling in summer, the set temperature of the temperature controller 1 can be appropriately increased to reduce electricity consumption; when the electric appliance performs heating in winter, the set temperature of the temperature controller 1 can be appropriately decreased to reduce electricity consumption.

The carbon saving mode of the temperature controller 1 can relatively increase the output of the electric appliance when the green electricity index GEI is high, so as to store more electric power in the form of cold energy or heat energy; and when the green electricity index GEI is low, the stored cold energy or heat energy can be utilized, so as to appropriately reduce the output power of the electric appliance and reduce the use of thermal electricity. By optimizing the temperature setting method of the temperature controller 1 in the above manner, carbon emissions can be effectively reduced while meeting normal temperature control needs.

It is to be noted that: the so-called "carbon saving mode" is a mode in which the set temperature is adjusted according to the green electricity index GEI, in order to reduce carbon emissions. In some embodiments of the present application, the surface of the temperature controller 1 may be provided with a key to trigger the entry into the carbon saving mode, or further be provided with a display unit to separately display the carbon saving mode; and in some other embodiments, the carbon saving mode may be entered on the basis of other triggering conditions, without limitation herein.

In one or more embodiments of the present application, determining the set temperature of the carbon saving mode may be performed locally at the temperature controller 1 or may run in a cloud terminal. In the present embodiment, determining the set temperature at a server 3 is introduced as an example, a person skilled in the art can understand that the same or similar steps or processes can also run locally at the temperature controller 1 in other embodiments of the present application.

System

Figure 2:
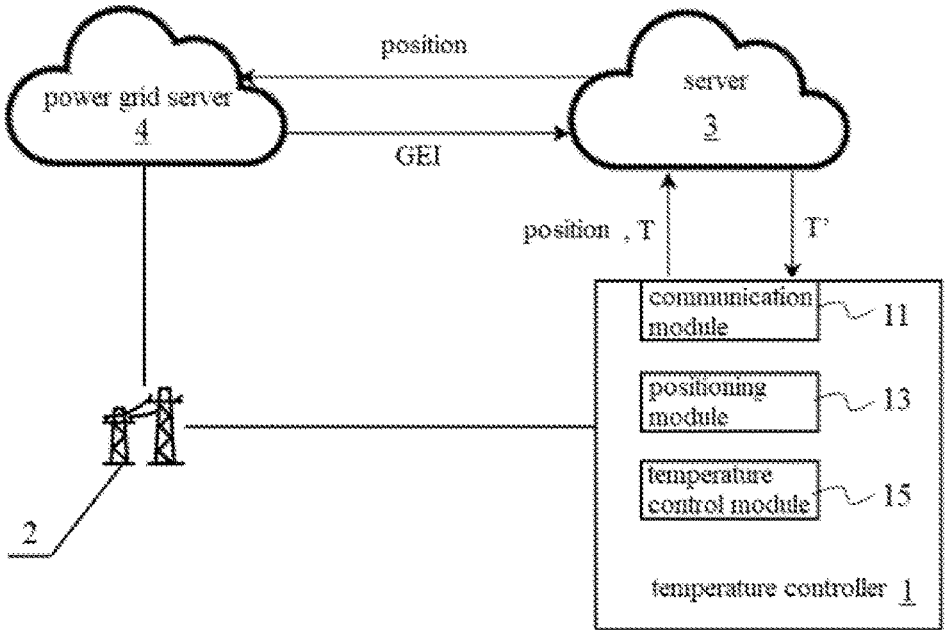
FIG. 2 is an architectural view of a system provided by one or more embodiments of the present application.

FIG. 2 is an architectural view of a system provided by the present embodiment. The system includes a temperature controller 1, a power grid, a server 3 and a power grid server 4.

The temperature controller 1 may for example be one or more temperature controllers 1 in an air conditioning system of a building such as an office building, a shopping mall or the like. The air conditioning system is preferably connected to the mains supply and powered by the power grid, i.e., the temperature controller 1 is electrically connected to the power grid.

Referring to FIG. 2, the temperature controller 1 has a communication module 11 and a positioning module 13. The communication module 11 may be a wireless communication module such as a WIFI module, and a Bluetooth module, or a wired communication module for establishing a communication connection with the server 3 so as to upload a current set temperature T and receive an updated set temperature T'.

The positioning module 13 is used for storing or determining the installation location information of the temperature controller 1, for example, being a memory for storing the installation location information of the air conditioning system; the installation location information is entered by an installer when installing the air conditioning system, or, the positioning module 13 may be a GPS module for detecting and determining the installation location information when it is required.

In order to monitor the operational state of the power grid, the entity (entity) operating the power grid or a related entity is provided with the power grid server 4. For example, a power grid to which the office building is connected is a power grid of the East China region, and the power grid server 4 is a power grid server 4 that provides information about the operation of the power grid of the East China region. The power grid server 4 summarizes various types of operational state information of the power grid and provides a port for the server 3 to communicate with it. The server 3 provided by the entity operating the air conditioning system may communicate with the power grid server 4 by means of the port.

Power grids in different zones can have different green electricity indexes GEI, and in the present embodiment, according to the installation location information, the green electricity index GEI of the power grid to which the temperature controller 1 is connected can be found. The installation location information is the installation location information acquired by the positioning module 13 and uploaded to the server 3 by the communication module 11. The server 3 sends the installation location information to the power grid server 4 and sends a request to find the green electricity index GEI corresponding to the installation location information. After the power grid server 4 returns to the server 3 the found green electricity index GEI, the server 3 adjusts the set temperature on the basis of the green electricity index GEI, and then returns the updated set temperature T' to the temperature controller 1, and the updated set temperature T' is loaded by the temperature control module 15.

Server

Figure 3:
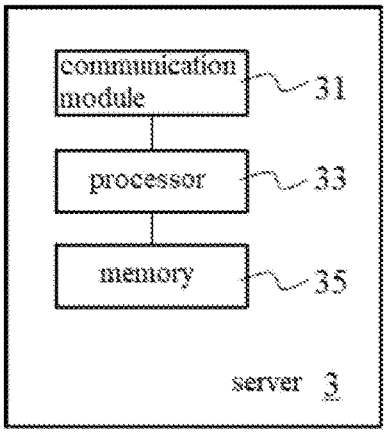
FIG. 3 is a structural view of a server in one or more embodiments of the present application.
Figure 4:
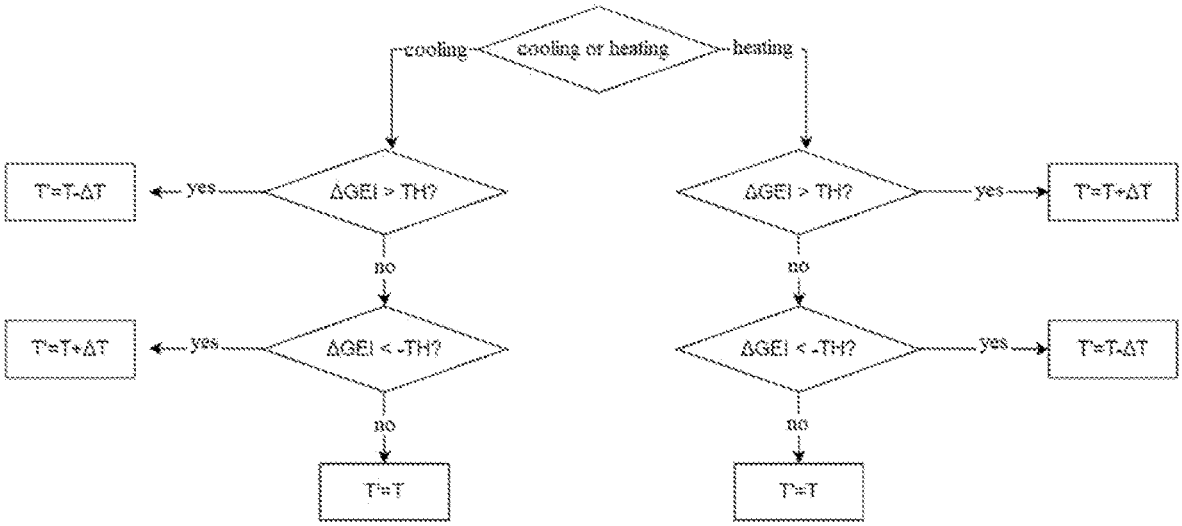
FIG. 4 is a flowchart of a method for updating a set temperature executable by the server in one or more embodiments of the present application.

FIG. 3 is a structural view of a server 3 in one or more embodiments of the present application. FIG. 4 is a flowchart of a method for updating a set temperature executable by the server 3.

Referring to FIG. 3, the server 3 includes a processor 33, a memory 35 and a communication module 31, the memory 35 stores processor-readable instructions, and by running the processor-readable instructions, the processor 33 enables the server 3 to execute the process as shown in FIG. 4. In the execution process, communication of the server 3 with other external devices is completed by the communication module 31.

As shown in FIG. 4, the method for updating a set temperature executed by the server 3 includes the following steps:

S1: the server 3 receives a current set temperature T of a temperature controller 1.

When the temperature controller 1 enters the carbon saving mode, the communication module 11 of the temperature controller 1 may send the current set temperature T to the server 3 at a specified time, or at a specified time interval, or in real time. In the following, the time for sending the current set temperature T being a specified time is illustrated as an example, for example, the temperature controller 1 entering the carbon saving mode may send the current set temperature T on the hour of each day, such as at 14:00, 15:00, and the like.

The installation location information may be sent to the server 3 in step S1, or may be sent to the server 3 prior to step S1 and saved by the server 3 in a manner associated with an MAC address or other characteristic values of the temperature controller 1.

After step S1, step S2 is performed: a green electricity index GEI is determined.

Referring to FIG. 2, the green electricity index GEI may be acquired by means of the power grid server 4, the power grid server 4 is connected to the server 3 by means of communication, the server 3 sends a green electricity index request command (containing the installation location information of the temperature controller 1) to the power grid server 4, and the power grid server 4 receives the green electricity index request command and then sends the green electricity index GEI corresponding to the installation location information to the server 3, thereby determining the green electricity index GEI.

In the present embodiment, the green electricity indexes GEI received at different moments are saved or cached by the server 3 associated with the MAC address of the temperature controller 1, and recorded as the historical record of the green electricity index GEI. The green electricity index GEI determined in step S2 may be the green electricity index GEI of the power grid at the current moment, or may be a green electricity index GEI' predicted according to the historical record for a future period of time. Specifically, a model may be trained on the basis of the historical record of the green electricity index, and the predicted value of the green electricity index in the future period of time is determined according to the model. The training and application of the model may be accomplished at the power grid server 4 or at the server 3.

After step S2, step S3 is executed: according to the green electricity index GEI of the power grid to which the temperature controller 1 is connected, the set temperature of the temperature controller 1 is adjusted so as to obtain an updated set temperature T', where the green electricity index GEI is the proportion of green electricity in the power grid to which the temperature controller 1 is connected.

Continuing to refer to FIG. 4, step S3 further includes the following process.

First, determining whether the air conditioning system connected or controlled by the temperature controller 1 is performing cooling or heating. The information may be uploaded by the temperature controller 1 to the server 3, or may be determined by the server 3 according to a comparison between the current ambient temperature and the set temperature. For example, if the set temperature is lower than the current ambient temperature, it is determined that the air conditioning system is in cooling operation; if the set temperature is higher than the current ambient temperature, it is determined that the air conditioning system is in heating operation. In addition, the current seasonal information, installation location information, etc. can also be combined for determination.

Next, the absolute value $|\Delta GEI|$ of the change amount $\Delta GEI$ of the green electricity index GEI is compared with a threshold TH.

In the present embodiment, in order to improve the stability of the set temperature and enhance the physical sensation of a user in the carbon saving mode, the threshold TH is set, and when the absolute value of the change amount of the green electricity index GEI is less than the threshold TH, the set temperature remains unchanged; when the absolute value of the change amount of the green electricity index GEI is greater than the threshold TH, the change tendency of the green electricity index GEI is judged. For example, the threshold TH may be 10%, and if the $\Delta GEI$ is greater than 10%, the set temperature T is increased or decreased by $\Delta T$ (e.g., 2° C.) according to the change tendency, otherwise the set temperature remains unchanged.

It is to be noted that: the change amount $\Delta GEI$ of the green electricity index GEI may be the difference between the current green electricity index GEI and the most recently recorded green electricity index GEI in the historical record, or the difference between the predicted value of the green electricity index GEI in a future period of time and the current green electricity index GEI, or any other change amount that may reflect the change trend of the green electricity index GEI.

By setting the change amount $\Delta GEI$ of the green electricity index GEI as the difference between the predicted value of the green electricity index GEI in a future period of time and the current green electricity index GEI, it is possible to allow for a certain time lag in the release of the green electricity index GEI and still be able to adjust the set temperature timely to reduce carbon emissions.

When the air conditioning system controlled by the temperature controller 1 is in cooling operation, the set temperature is decreased if the amount of increase in the green electricity index GEI exceeds a threshold, and the set temperature is increased if the amount of decrease in the green electricity index GEI exceeds a threshold. When the air conditioning system controlled by the temperature controller 1 is in heating operation, the set temperature is increased if the amount of increase in the green electricity index GEI exceeds a threshold, and the set temperature is decreased if the amount of decrease in the green electricity index GEI exceeds the threshold.

"Increasing the set temperature" and "decreasing the set temperature" are performed on the basis of the current set temperature T. The amplitude of increase or decrease can be a fixed value, such as 1-3° F., or can be adjusted on the basis of the amount of change $\Delta GEI$ in the green electricity index.

During cooling, if the amount of increase in the green electricity index GEI exceeds the threshold TH, the set temperature is decreased, so that green electricity can be more converted into cold energy for storage. The stored cold energy can be used when the green electricity index GEI is low to meet the cooling demand when the green electricity index GEI is low, which increases the use of green electricity and decreases the use of thermal electricity, thereby reducing carbon emissions.

Similarly, during heating, if the amount of increase in the green electricity index GEI exceeds the threshold TH, the set temperature is increased, so that green electricity can be more converted into heat energy for storage. The stored heat energy can be used when the green electricity index GEI is low to meet the heating demand when the green electricity index GEI is low, which increases the use of green electricity and decreases the use of thermal electricity, thereby reducing carbon emissions.

Continuing to refer to FIG. 4, after step S3, step S4 is performed, the updated set temperature T' is sent to the temperature controller 1, which is loaded and executed by the temperature control module 15 of the temperature controller 1.

With the above method, the server can centrally process and coordinate the calculation of the set temperature, flexibly adjust the set temperature of the temperature controller 1 according to the green electricity index GEI, and reduce carbon emissions.

In some embodiments of the present application, the flowchart of the method for updating the set temperature shown in FIG. 4 can also run in the temperature controller 1 or other electric appliances for controlling temperature to adjust the set temperature of the temperature controller 1 or other electric appliances for controlling temperature to reduce carbon emissions.

In some other embodiments of the present application, the set temperature can also be adjusted on the basis of the result of comparison between the green electricity index GEI and a preset value. For example, when the green electricity index GEI is greater than a first preset value and the electric appliance is in a cooling mode, the set temperature is decreased; when the green electricity index GEI is less than the first preset value, the set temperature is increased or the set temperature remains unchanged.

The electric appliance used for controlling temperature to which the temperature controller 1 in the embodiment of the present application is applied is not limited to the air conditioning system listed in the above embodiment, can also be other electric appliances for cooling and/or heating, and are not limited to household or industrial electric appliances for cooling and/or heating, such as refrigerators, storage cabinets, freezers, and other refrigeration appliances; alternatively, the electric appliance may be an electric heating shower or other industrial electric heating devices.

In some embodiments, the processor 33 may be a general-purpose processor, a processor core, a multiprocessor, a reconfigurable processor, a microcontroller, a digital signal processor (DSP), an application-specific integrated circuit (ASIC), a graphics processing unit (GPU), a field programmable gate array (FPGA), a programmable logic device (PLD), a controller, a state machine, gating logic, discrete hardware components or any other processing unit, as well as a combination of one or more processors mentioned above. The memory 35 can be an independent external memory, including but not limited to a random access memory (RAM), a read-only memory (ROM), a programmable read-only memory (PROM), an erasable programmable read-only memory (EPROM), and an electrically erasable programmable read-only memory (EEPROM). The present embodiment does not limit the specific forms of the processor 33 and the memory 35.

Those skilled in the art should understand that some embodiments of the present application may be provided as methods, systems, or computer program products. Therefore, the present application may adopt a complete hardware implementation method, a complete software implementation method, or a combination of software and hardware implementation methods. In addition, the present application may use a form of a computer program product implemented on one or more computer-usable storage media (including but not limited to a disk memory, CD-ROM, an optical memory, and the like) including computer-usable program codes. It will be appreciated that while the present embodiment exemplifies a plurality of technical subjects, the contents of the various technical subjects are combinable with each other.

The description above is only preferred embodiments of the present application and not intended to limit the present application. Any modification, equivalent replacement, improvement, etc. made within the spirit and principle of the present application shall fall within the protection scope of the present application.

The invention claimed is:

1. A temperature controller, wherein the temperature controller is able to be configured to operate in a carbon saving mode, and when operating in the carbon saving mode, a set temperature of the temperature controller is adjusted according to a green electricity index, and the green electricity index is the proportion of green electricity in a power grid to which the temperature controller is connected, wherein the set temperature is unchanged, if an absolute value of a change amount of the green electricity index is less than a threshold, and/or wherein the set temperature is increased or decreased, if the absolute value of the change amount of the green electricity index is greater than the threshold.

2. The temperature controller according to claim 1, wherein the temperature controller comprises a communication module, and when the temperature controller operates in the carbon saving mode, the communication module uploads a current set temperature and receives an updated set temperature based on the green electricity index.

3. The temperature controller according to claim 2, wherein the temperature controller further comprises a positioning module used for storing or determining installation location information of the temperature controller;

the communication module also uploads the installation location information so as to find the green electricity index on the basis of the installation location information.

4. The temperature controller according to claim 2, wherein the communication module uploads the current set temperature and receives the updated set temperature at a specified time, or at a specified time interval, or in real time.

5. The temperature controller according to claim 1, wherein in a case that the temperature controller controls a cooling system, if the green electricity index increases, the set temperature is decreased, and if the green electricity index decreases, the set temperature is increased.

6. The temperature controller according to claim 1, wherein in a case that the temperature controller controls a heating system, if the green electricity index increases, the set temperature is increased, and if the green electricity index decreases, the set temperature is decreased.

7. The temperature controller according to claim 1, wherein the temperature controller also adjusts the set temperature according to a trend prediction result of the green electricity index.

8. A server according to claim 1, comprising:

a processor, and a memory, the memory storing processor-readable instructions, the processor performing, by running the processor-readable instructions, the following steps:

receiving a current set temperature of the temperature controller;

according to the green electricity index of the power grid to which the temperature controller is connected, adjusting the set temperature of the temperature controller so as to obtain an updated set temperature, the green electricity index being the proportion of green electricity in the power grid to which the temperature controller is connected; and sending the updated set temperature to the temperature controller.

9. An air conditioning system, wherein the air conditioning system has the temperature controller according to claim 1.

10. The temperature controller according to claim 1, wherein the set temperature is further adjusted based on a comparison between the green electricity index and a preset value, such that:

when the green electricity index is greater than the pre-set value and the temperature controller controls a cooling system, the set temperature is decreased; and when the green electricity index is less than the pre-set value, the set temperature is unchanged or is increased.

11. The temperature controller of claim 1, wherein the change amount of the green electricity index is the difference between a current green electricity index and a predicted value of the green electricity index in a future period.

12. A temperature setting method of an electric appliance for air conditioning, comprising the following steps:

according to a green electricity index of a power grid to which the electric appliance is connected, adjusting a set temperature of the electric appliance, the green electricity index being the proportion of green electricity in the power grid to which the electric appliance is connected, wherein the set temperature of the electric appliance is unchanged, if an absolute value of a change amount of the green electricity index is less than a threshold, and/or wherein the set temperature of the electric appliance is increased or decreased, if the absolute value of the change amount of the green electricity index is greater than the threshold.

13. The temperature setting method of the electric appliance for controlling temperature according to claim 12, further comprising the following steps:

on the basis of installation location information of the electric appliance, finding the green electricity index of the power grid to which the electric appliance is connected.

14. The temperature setting method of the electric appliance for controlling temperature according to claim 12, wherein the electric appliance is used for cooling, the step of "according to a green electricity index of a power grid to which the electric appliance is connected, adjusting the set temperature of the electric appliance" comprises:

in a case that the green electricity index increases, decreasing the set temperature; and in a case that the green electricity index decreases, increasing the set temperature.

15. The temperature setting method of the electric appliance for controlling temperature, according to claim 12, wherein the electric appliance is used for heating, the step of "according to a green electricity index of a power grid to which the electric appliance is connected, adjusting the set temperature of the electric appliance" comprises:

in a case that the green electricity index increases, increasing the set temperature; and in a case that the green electricity index decreases, decreasing the set temperature.

16. The temperature setting method of the electric appliance for controlling temperature according to claim 12, further comprising the following steps, according to the historical record of the green electricity index of the power grid to which the electric appliance is connected, predicting the change tendency of the green electricity index to obtain a tendency prediction result; and in the step of "according to a green electricity index of a power grid to which the electric appliance is connected, adjusting the set temperature of the electric appliance", further, according to the tendency prediction result, adjusting the set temperature.

17. A temperature controller, wherein the temperature controller is able to be configured to operate in a carbon saving mode, and when operating in the carbon saving mode, a set temperature of the temperature controller is adjusted according to a green electricity index, and the green electricity index is the proportion of green electricity in a power grid to which the temperature controller is connected, wherein the temperature controller comprises a communication module, and when the temperature controller operates in the carbon saving mode, the communication module uploads a current set temperature and receives an updated set temperature based on the green electricity index, and wherein the temperature controller further comprises a positioning module configured for storing or determining installation location information of the temperature controller, wherein the communication module uploads the installation location information to determine the green electricity index based on the installation location information.

* * * * *